United States Patent [19]

Nixon, Jr.

[11] 4,185,704

[45] Jan. 29, 1980

[54] DIRECTIONAL DRILLING APPARATUS

[75] Inventor: Jeddy D. Nixon, Jr., Houston, Tex.

[73] Assignee: Maurer Engineering Inc., Houston, Tex.

[21] Appl. No.: 902,377

[22] Filed: May 3, 1978

[51] Int. Cl.[2] ..... E21B 7/06

[52] U.S. Cl. ..... 175/76; 175/325

[58] Field of Search ..... 175/61, 73, 76, 97, 175/98, 99, 230, 323, 325, 78; 166/212; 308/4 A

[56] References Cited

U.S. PATENT DOCUMENTS

| | | | |
|---|---|---|---|
| 1,903,467 | 4/1933 | MacClatchie | 308/4 A |
| 2,014,805 | 9/1935 | Hinderliter | 175/325 |
| 2,332,749 | 10/1943 | Page | 166/212 |
| 2,604,365 | 7/1952 | Howard | 308/4 A |
| 2,796,234 | 6/1957 | Mann | 175/76 |
| 2,874,784 | 2/1959 | Baker et al. | 166/212 |
| 3,023,821 | 3/1962 | Etherington | 175/76 X |
| 3,098,534 | 7/1963 | Carr et al. | 175/73 |
| 3,370,657 | 2/1968 | Antle | 175/230 X |
| 3,382,938 | 5/1968 | Williams, Jr. | 175/76 X |
| 3,528,500 | 9/1970 | Brown | 166/212 |
| 3,561,549 | 2/1971 | Garrison et al. | 175/76 |
| 3,747,700 | 7/1973 | Rilling | 175/323 X |
| 3,930,545 | 1/1976 | Sears | 175/76 X |
| 3,933,395 | 10/1976 | Evans | 308/4 A |
| 4,040,495 | 8/1977 | Kellner | 175/73 |
| 4,101,179 | 7/1978 | Barron | 175/325 X |

*Primary Examiner*—James A. Leppink
*Assistant Examiner*—Richard E. Favreau
*Attorney, Agent, or Firm*—Neal J. Mosely

[57] ABSTRACT

Apparatus for directional drilling in the earth comprises a down hole motor having a stator housing adapted to be connected to a string of drill pipe at one end and having a rotor shaft extending out the other end. The rotor shaft is adapted to receive and drive any suitable rotary bit. The stator housing is provided with fulcrum means in the form of a barrel member having arcuate longitudinal cross section. The fulcrum member is of substantially the same size as the hole being bored and is engageable with the side wall of the hole to provide a fulcrum about the drilling motor can be turned to change direction. A suitable deflection means is positioned at the end of the stator housing adjacent to the connection to the drill string and includes a laterally moveable thrust member which is operable to engage one side of the hole being drilled to deflect the stator housing in the opposite direction and pivot the same on the fulcrum point to change the direction of the hole being drilled. The thrust member may be actuated by any suitable mechanical connecting means or is preferably operated by a remotely controlled pressure operated means.

10 Claims, 7 Drawing Figures

Fig. 4
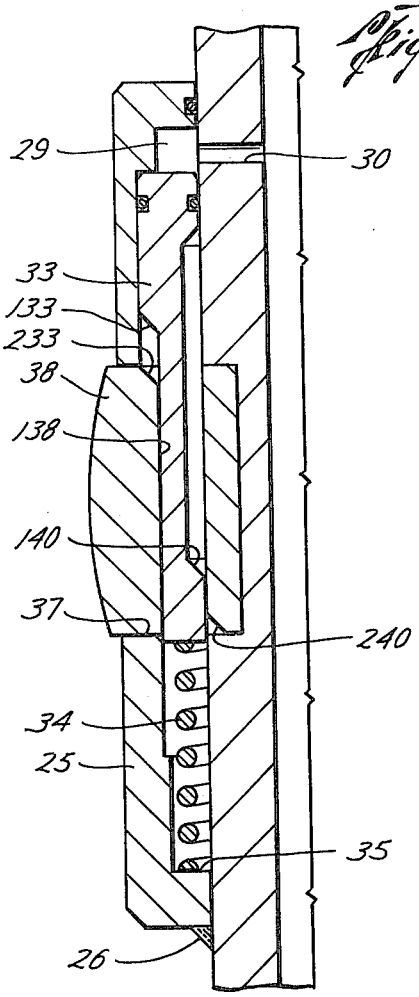
Fig. 5
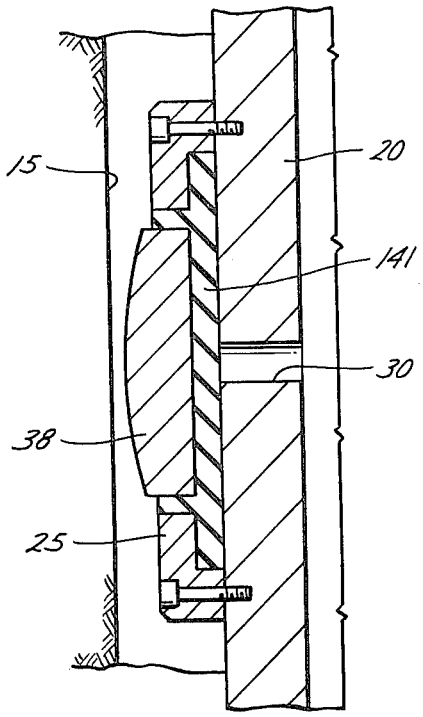
Fig. 6
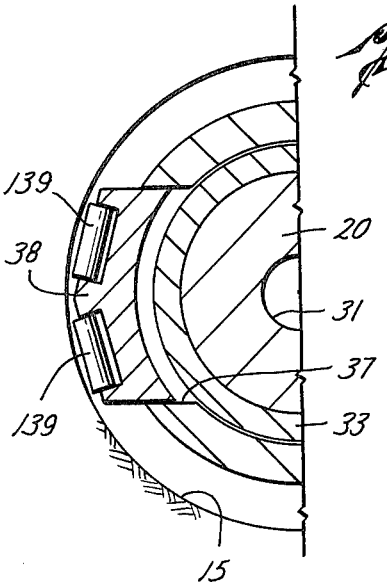
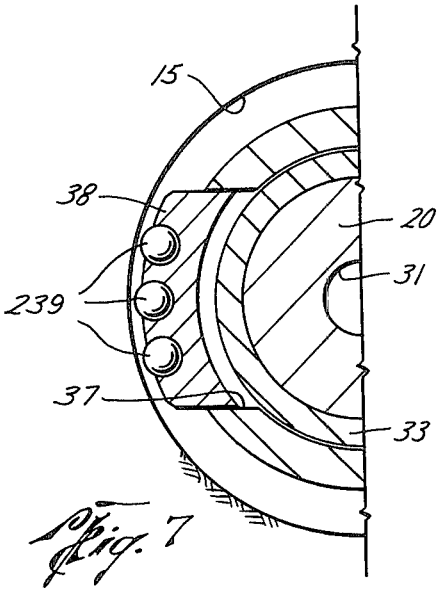
Fig. 7

DIRECTIONAL DRILLING APPARATUS

BACKGROUND OF THE INVENTION

1. Field of the Invention

This invention relates to new and useful improvements in earth boring apparatus and more particularly to apparatus for directional drilling in the earth.

2. Description of the Prior Art

In directional drilling, maintaining the direction is a major element since most holes are angled and then aimed at a target. In practice, regular surveys must be taken and the bit weight in the stabilized section of the drill string changed as the formations change. The theory of maintaining a straight hole has been well developed. The bit goes where it is pushed or deflected and it is possible to stabilize the drill string to maintain any constant direction and angle.

The main forces acting on a drill bit are the pendulum forces of gravity, leeward forces of the drill string, the wedging effect of formation changes and the walking effect of rotation, especially in tricone bits. These forces may be controlled by proper control of the bit weight, stiffening the drill string by using larger drill collars or square drill collars, and by placement of stabilizers in the collar string.

There are several ways of changing direction in a well. These ways include changing bit weight, changing drill collar stabilization, use of a bent sub, use of a directional whipstock, and jetting. Changing the weight on the bit is one of the most common forms of direction control. Depending upon the arrangement of the stiffening string, the bit can be made to back towards vertical or increase the angle. Changes in stabilizer arrangement can build or decrease angle by using pendulum or lever effects. The bent sub and the whipstock, however, are the tools on which commercial directional drilling has been based. Bent subs and whipstocks, however, require many round trips of the drilling apparatus for only a small amount of hole obtained. As a result, there has been a substantial need for a suitable means for effecting directional control of drilling apparatus, and particularly drilling apparatus utilizing in-hole motors, such as the turbo drill, which does not require repeated trips to the surface of the drilling apparatus.

The use of bit-deflection barrels is known in the prior art, e.g. U.S. Pat. Nos. 3,460,639, 3,298,449 and 3,326,305. The use of deflection barrels in association with in-hole motors is known in U.S. Pat. Nos. 2,637,527 and 3,023,821. U.S. Pat. No. 4,040,495 discloses a bit deflection apparatus for an inhole drilling motor. The prior art referred to above has the disadvantage of either requiring frequent trips of the apparatus or in lacking means to provide a substantial mechanical advantage in application of the bit deflection forces.

SUMMARY OF THE INVENTION

This invention relates to new and useful improvements in apparatus for directional drilling in the earth. It is particularly adapted to the use of in-hole drilling motors such as the turbo drill. The apparatus includes a stator housing adapted to be connected at one end to a string of drill pipe and having a rotor shaft supported therein and extending from the other end which is adapted to support a rotary drill bit, such as tricone bit, thereon. Means is provided on the stator housing which is engagable with one side of the drill hole to provide a fulcrum for changing direction of the drilling apparatus and of the hole being drilled. This means is preferably a barrel-shaped stabilizer member of arcuate longitudinal cross section. This member is preferably located adjacent the bit end of the stator housing. At the other end of the stator housing, adjacent to the connection to the drill string, there is positioned a suitable means for engaging the side of the drill hole to effect a deflection of the stator housing laterally and move the same around the pivot or fulcrum point provided by the stabilizer member. The stator housing moving means preferably consists of a laterally movable thrust member which may be operated mechanically or by application of fluid pressure to move the same laterally to engage the side of the hole and deflect the upper or rearward end of the stator housing.

BRIEF DESCRIPTION OF THE DRAWINGS

FIG. 4 is a longitudinal sectional view similar to FIG. 2 of another embodiment of the apparatus.

FIG. 5 is a longitudinal sectional view similar to FIGS. 2 and 4 of still another embodiment of the drilling motor deflection apparatus.

FIG. 6 is a sectional view similar to FIG. 3 illustrating another embodiment of drilling motor-deflection thrust member.

FIG. 7 is a sectional view similar to FIGS. 3 and 6 showing still another embodiment of drilling motor-deflection thrust member.

DESCRIPTION OF THE PREFERRED EMBODIMENTS

Figure 1:
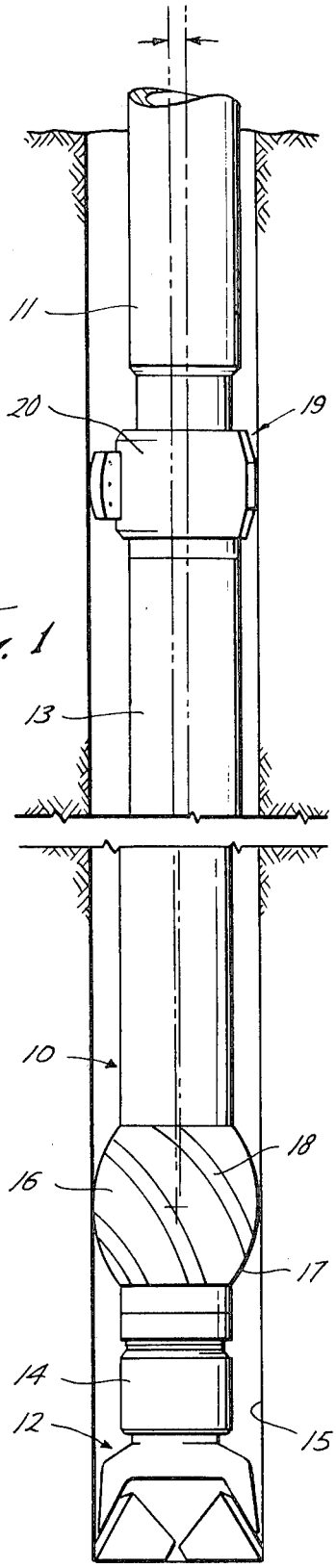
FIG. 1 is a view in elevation of a directional drilling apparatus that is one preferred embodiment of the invention.
Figure 2:
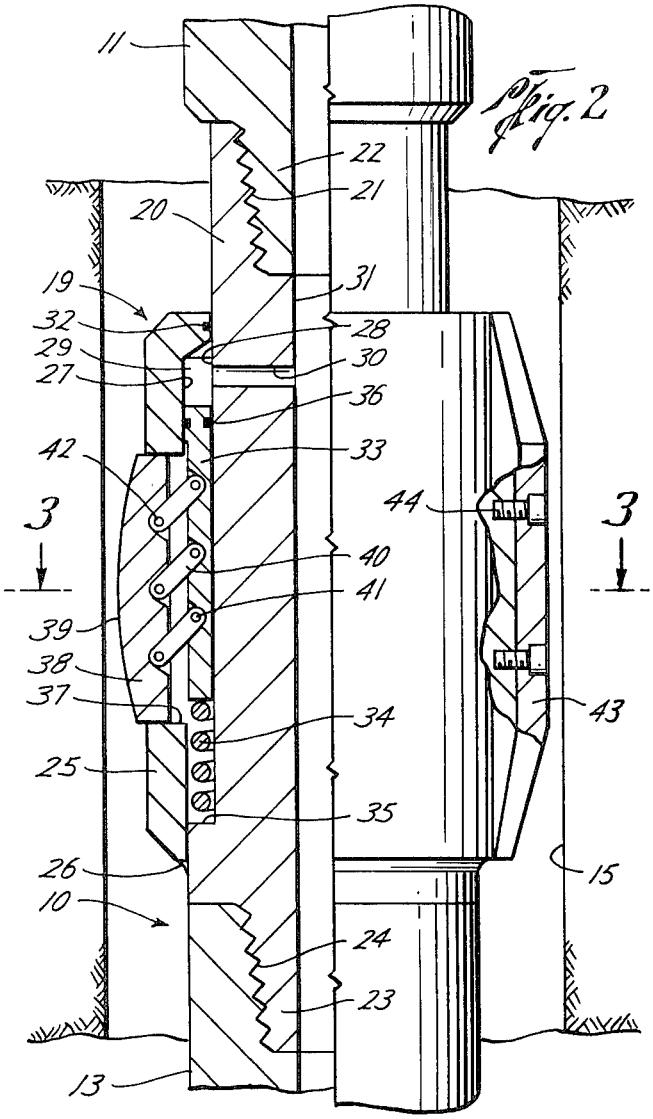
FIG. 2 is a slightly enlarged view in longitudinal section of the drilling motor deflecting means shown in FIG. 1.
Figure 3:
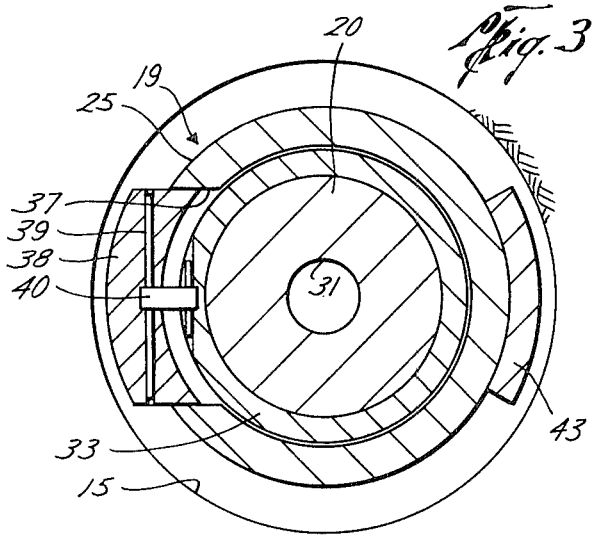
FIG. 3 is a sectional view taken on the line 3—3 of FIG. 2.

Referring now generally to FIGS. 1 to 3, there is shown an in-hole drilling motor 10 which is connected at its upper end to the lower part of a string of drilling pipe 11 and at its lower end to a rotary drill bit 12, preferably a tricone roller bit.

The in-hole drilling motor 10 includes stator housing 13 and rotor shaft 14 of any suitable design. The in-hole motor 10 is preferably a turbo drill having a system of turbine blades in stator housing 13 and on rotor shaft 14 which cooperate to effect the rotation of rotor shaft 14 when fluid is circulated therethrough. The fluid which is circulated through in-hole motor 10 may be water or drilling mud or any other suitable drilling fluid. The particular design of in-hole motor 10 is not set forth since any suitable in-hole motor could be used. Copending U.S. patent application Ser. No. 849,978, filed Nov. 9, 1977, now abandoned, discloses a suitable in-hole drilling motor of the turbo drill type. Other in-hole motors, such as Moineau motors, positive displacement motors, etc. may be used.

In FIG. 1, the apparatus is shown in position in bore hole 15. The stator housing 13 is provided with a suitable means abutting the edge of bore hole 15 to provide a fulcrum for effecting a change in the direction of drilling operation. This means consists of a barrel-shaped drill stabilizer 16 carried on stator housing 13. Stabilizer 16 has an external surface configuration 17 which is arcuate in longitudinal cross section and is provided with a plurality of grooves 18 which allow for circulation of drilling fluid past the stabilizer.

At the upper end of stator housing 13 there is secured a suitable means for effecting lateral movement of the upper end of the in-hole drilling motor to cause the same to pivot on stabilizer fulcrum member 16 to change the direction of drilling. This deflection means consists of a deflection sub generally designated 19 and shown in more detail in FIGS. 2 and 3. Deflection sub 19 consists of tubular member 20 which has a threaded box 21 at its upper end receiving the threaded pin 22 of the lower most member of drill string 11. The lower end of tubular member 20 is provided with a threaded pin 23 which fits in the threaded box end 24 of stator housing 13. Tubular housing 25 surrounds tubular member 20 and is welded in position as indicated at 26. The inner wall 27 of tubular member 25 is spaced from the outer wall 28 of tubular member 20 and provides an annular chamber 29 therein. Aperture 30 opens from the bore 31 of tubular member 20 into chamber 29 for admission of fluid pressure therein. "O" ring 32 provides a fluid-tight seal at the upper end of housing 25. A tubular piston member 33 is slidably positioned on tubular member 20 and slides longitudinally within chamber 29. A helical spring 34 is positioned against shoulder 35 at the lower end of tubular member 20 and abuts the lower end of piston 33 to urge the same in an upward or rearward direction. Piston 33 is provided with "O" sealing the same against leakage of fluid.

Tubular housing 25 is provided with an aperture or window 37 opening into chamber 29 adjacent piston 33. A thrust member or pad 38 is positioned in aperture or window 37 and movable laterally of the deflection sub. The outer surface 39 of thrust pad 38 is preferably provided with a suitable hard facing such as a coating of tungsten carbide or the like. A plurality of pivot or lever members 40 are pivotally supported on piston 33 as indicated at 41 and on thrust pad 38 as indicated at 42. On the side of the deflection sub opposite thrust pad 38 there is provided a wear plate 43 secured in place by cap screws or the like 44. Wear plate 43 is preferably provided with a surface of suitable hard facing material such as sinerade tungsten carbide.

The operation of this apparatus is fully obvious from the description of the component parts and their assembly and function. However, a more complete description of operation will be given for a complete understanding of the invention.

In the embodiment shown in FIGS. 1 to 3, drill 11 is rotated by rotation of shaft 14 effected by circulation of drilling fluid through drill string 11 and in-hole motor 10. Stabilizer or fulcrum member 16 is of full gauge and slides within the bore of hole 15. Grooves 18 on member 16 allow for circulation of drilling fluid and cuttings back up the hole.

In a normal undeviated operation, the deviation sub is substantially in the position shown in FIG. 2. Piston 33 is moved to an upper or rearward position by spring 34 and deflection pad or thrust member 38 is moved laterally inward. Likewise, wear pad 43 is positioned away from the bore of hole 15.

In this position, the in-hole motor is operating to rotate drill bit 12 and drill the hole 15 in a relatively straight direction. The application of a predetermined pressure of drilling fluid will apply fluid pressure through aperture 30 in the wall of tubular member 23 into the end of chamber 29 above or rearward of piston 33. This pressure causes piston 33 to move downward or forward and moves links 40 to force deflection pad or thrust member 38 laterally outward. Deflection pad or thrust member 38 engages the wall of hole 15 and as it moves further outward forces the deflection sub to move in the opposite direction until further movement is limited by engagement of wear pad 43 with the opposite side of the bore of hole 15. This amount of movement is indicated by the angle between the arrows at the top of the apparatus in FIG. 1. This lateral movement of deflection sub 19 causes the upper end of stator housing 13 to be moved as indicated in FIG. 1 and causes the full length of stator housing 13 and rotor shaft 14 to pivot on the fulcrum provided by the full gauge stabilizer member 16. This causes drill bit 12 to be deflected to the left as seen in FIG. 1 and begin to change the direction of the hole toward the left. This deflection mechanism can be maintained in an activated position to continue to deflect the drill motor and drill bit to provide for a very substantial deviation in the direction of drilling over an extended period of time. Since the deflection sub can be actuated by variation in the fluid pressure applied to piston 33 it is possible to actuate the deflection sub for a predetermined time of operation and to release the same from the actuated position to permit further drilling operation in a straight undeviated line.

AN ALTERNATE EMBODIMENT

In FIG. 4, there is shown an alternate embodiment of the deflection sub 19. The portions of the deflection sub which are the same as in FIGS. 1 to 3 are given the same reference numerals and only the points of modification are given different reference numerals.

In this embodiment, deflection pad or thrust member 38 is provided with internal slot 138 through which the piston 33 extends. Piston 33 is provided with a cam surface 133 which engages a matching surface 233 on thrust member 38. Downward or forward movement of piston 33 causes cam surfaces 133 and 233 to effect a positive outward movement of thrust member 38. Piston 33 is also provided with cam surface 140 which cooperates with cam surface 240 on thrust member 38 to effect a laterally inward movement of thrust member 38 upon upward or rearward movement of piston 33 upon reduction of the fluid pressure applied thereto.

ANOTHER EMBODIMENT

In FIG. 5, there is shown a still further embodiment in which the deflection pad or thrust member 38 is operated by application of fluid pressure to a flexible diaphragm.

Tubular member 20 is provided with aperture 30 which supplies fluid pressure to the inside of flexible diaphragm 141 which is positioned in space 29 between housing 25 and tubular member 20. Thrust pad 38 is moved outward or retracted by increase or reduction in fluid pressure applied to rubber or elastometeric diaphragm 141 through aperture 30.

STILL FURTHER EMBODIMENTS

In FIGS. 6 and 7, there are illustrated two further embodiments in which rotary bearing means is provided in the surface of deflection pad or thrust member 38. The means for actuation of deflection member or thrust pad 38 may be as shown in FIGS. 2, 4 or 5 or by any other suitable means.

In FIG. 6, deflection pad or thrust member 38 is provided will roller bearings 139 supported in the surface thereof. Roller bearings 139 are engagable with the bore or wall of hole 15 upon lateral outward movement of thrust member 38 and provide a rolling contact therewith. In FIG. 7, a similar modification is shown in which ball bearings 239 are provided in deflection pad or thrust member 38 which similarly provide for a rolling contact with the bore wall of hole 15. The embodiments shown in FIGS. 6 and 7 facilitate the downward or forward movement of the in-hole drilling motor while the deflection sub is in a fully actuated position. These bearings reduce the frictional drag on the wall of the bore hole 15 when deflection pad or thrust member 38 is in a fully actuated position.

While this invention has been fully and completely described with special emphasis upon several preferred embodiments, it should be understood that within the scope of the appended claims the invention may be practiced otherwise than as specifically described therein. In particular, any suitable mechanical means may be used for effecting lateral movement of the deflection pad or thrust member 38 in the deflection sub to cause the stator housing and rotor shaft to pivot on fulcrum member or stabilizer 16.

I claim:

1. Apparatus for directional drilling in the earth comprising, a stator housing adapted to be connected at one end to a string of drill pipe, a rotor shaft supported for rotation in said stator housing and having one end extending from the other end of said stator housing and adapted to support a drill bit thereon, means supported on said stator housing adjacent one end thereof engagable with one side of the hole being drilled to provide a fulcrum for changing the direction of said hole, a thrust member supported on said stator housing adjacent the other end thereof and operable to be moved laterally therefrom to engage the side of said hole opposite said one side to move said stator housing laterally in the opposite direction to pivot about said fulcrum and change the axis of rotation of said rotor shaft and thereby change the direction of drilling said hole, a fluid pressure operated piston positioned for movement longitudinally of said housing adjacent to said thrust member, means operatively interconnecting said piston and said thrust member to effect lateral movement of said thrust member upon movement of said piston, said means supported on said stator housing comprising a barrel member secured thereon and having an external surface that is arcuate in longitudinal cross section and having spiral grooves therein, and said barrel member being positioned relative to said movable means in the relation of a lever of the first order.

2. Apparatus for directional drilling in the earth comprising a stator housing adapted to be connected at one end to a string of drill pipe, a rotor shaft supported for rotation in said stator housing and having one end extending from the other end of said stator housing and adapted to support a drill bit thereon, means on said stator housing engageable with one side of the hole being drilled to provide a fulcrum for changing the direction of said hole, means supported on said stator housing and operable to be moved laterally therefrom to engage the side of said hole opposite said one side to move said stator housing laterally in the opposite direction to pivot about said fulcrum and change the axis of rotation of said rotor shaft and thereby change the direction of drilling said hole, said movable means comprising a sub secured to and removable from said one end of said stator housing, said sub comprising a tubular member threaded at one end for securing said sub to said stator housing and threaded at the other end for securing said sub to a string of drill pipe, a tubular housing secured on said tubular member and having a wall spaced therefrom to provide a chamber, an aperture in said wall, a thrust member positioned in said aperture for lateral movement, pressure actuated means positioned in said chamber to move said thrust member in response to application of fluid pressure, said pressure actuated means comprising a piston slidably positioned in said chamber and operatively engageable with said thrust member, spring means positioned in said chamber engaging said piston and urging the same in one direction, and said tubular member having an aperture opening into said chamber for introduction of fluid pressure to the end of said piston opposite said spring.

3. Apparatus according to claim 2 including a lever linkage between said piston and said thrust member to effect lateral movement of said thurst member upon longitudinal movement of said piston.

4. Apparatus according to claim 2 in which said piston and said thrust member have cooperating cam surfaces engagable to effect lateral movement of said thrust member upon longitudinal movement of said piston.

5. Apparatus for directional drilling in the earth comprising a stator housing adapted to be connected at one end to a string of drill pipe, a rotor shaft supported for rotation in said stator housing and having one end extending from the other end of said stator housing and adapted to support a drill bit thereon, a barrel member, arcuate in longitudinal section, secured on said stator housing engageable with one side of the hole being drilled to provide a fulcrum for changing the direction of said hole, means supported on said stator housing, spaced from said barrel member, and operable to be moved laterally therefrom to engage the side of said hole opposite said one side to move said stator housing laterally in the opposite direction to pivot about said fulcrum in the relation of a lever of the first order to change the axis of rotation of said rotor shaft and thereby change the direction of drilling said hole, said movable means comprising a sub secured to and removable from said one end of said stator housing, said sub comprising a tubular member threaded at one end for securing said sub to said stator housing and threaded at the other end for securing said sub to a string of drill pipe, a tubular housing secured on said tubular member and having a wall spaced therefrom to provide a chamber, an aperture in said wall, a thrust member positioned in said aperture for lateral movement, pressure actuated means positioned in said chamber to move said thrust member in response to application of fluid pressure, said pressure actuated means comprising a piston slidably positioned in said chamber and operatively engageable with said thrust member, spring means positioned in said chamber engaging said piston and urging the same in one direction, and said tubular member having an aperture opening into said chamber for introduction of fluid pressure to the end of said piston opposite said spring.

6. Apparatus according to claim 5 including a lever linkage between said piston and said thrust member to effect lateral movement of said thrust member upon longitudinal movement of said piston.

7. Apparatus according to claim 5 in which said piston and said thrust member have cooperating cam surfaces engageable to effect lateral movement of said thrust member upon longitudinal movement of said piston.

8. Apparatus for directional drilling in the earth comprising a stator housing adapted to be connected at one end to a string of drill pipe, a rotor shaft supported for rotation in said stator housing and having one end extending from the other end of said stator housing and adapted to support a drill bit thereon, a barrel member supported on said stator housing adjacent one end thereof, having an external surface that is arcuate in cross-section and having spiral grooves therein, engageable with one side of the hole being drilled to provide a fulcrum for changing the direction of said hole, movable means comprising a sub secured to and removable from said one end of said stator housing, said sub comprising a tubular member threaded at one end for securing said sub to said stator housing and threaded at the other end for securing said sub to a string of drill pipe, a tubular housing secured on said tubular member and having a wall spaced therefrom to provide a chamber, an aperture in said wall, a single thrust member positioned in said aperture for lateral movement, pressure actuated means positioned in said chamber to move said thrust member in response to application of fluid pressure to engage the side of said hole opposite said one side to move said stator housing laterally in the opposite direction to pivot about said fulcrum and change the axis of said rotor shaft, and said barrel member being positioned relative to said movable means in the relation of a lever of the first order.

9. Apparatus according to claim 8 in which said pressure actuated means comprises a diaphragm positioned in said chamber and movable in response to application of a predetermined fluid pressure thereto.

10. Apparatus according to claim 8 including rotary bearing means supported in the surface of said thrust member engageable with the wall of the hole being drilled.

* * * * *